United States Patent [19]

Hood

[11] 4,044,409

[45] Aug. 30, 1977

[54] VERTICALLY SLOTTED STRAINER

[76] Inventor: Harry N. Hood, 302 Thorn St., San Diego, Calif. 92103

[21] Appl. No.: 664,888

[22] Filed: Mar. 8, 1976

[51] Int. Cl.[2] ..... E03C 1/26

[52] U.S. Cl. ..... 4/292; 4/286

[58] Field of Search ..... 4/292, 189, 190, 286, 4/290, 291; 210/482, 467, 473, 464, 477, 460, 463, 166

[56] References Cited

U.S. PATENT DOCUMENTS

| | | | |
|---|---|---|---|
| 324,080 | 8/1885 | Butterfield | 210/477 |
| 590,243 | 9/1897 | Smith | 210/482 |
| 738,726 | 9/1903 | Lytle | 4/292 |
| 1,161,766 | 11/1915 | Ferran | 4/291 |
| 2,336,348 | 12/1943 | Demers | 210/482 |

FOREIGN PATENT DOCUMENTS

| | | | |
|---|---|---|---|
| 105,535 | 4/1917 | United Kingdom | 4/286 |

*Primary Examiner*—Robert I. Smith

[57] ABSTRACT

A sink strainer for insertion into a sink drain having a vertical cylindrical member with vertical slots therein and a stopper at a top opening thereof with a lower portion being dimensioned for insertion into a sink drain. A funnel member is coupled to the vertical member for capturing solid objects and allowing liquid to pour through the vertical slots of the vertical member and into the drain.

2 Claims, 4 Drawing Figures

VERTICALLY SLOTTED STRAINER

BRIEF DESCRIPTION OF THE INVENTION

The present invention relates to a sink strainer and, more particularly, to a sink strainer having vertical slots therein for passage of liquid therethrough.

According to the invention, a sink strainer is provided having a vertical strainer member with vertical slots therein for allowing the passage of liquid therethrough and into the drain of the sink, and in one form of the invention the bottom portion of the vertical member being insertable into the drain opening of the sink. In the preferred embodiment, the vertical strainer member is surrounded by and coupled to a funnel member, the bottom portion of which extends below the vertical strainer member into a sink drain. For maximum efficiency, the combined area of the vertical slot openings should be equal to or greater than the area of the bottom opening of the funnel member or if used without the funnel member, the bottom opening of the vertical strainer member itself.

An object of the present invention is the provision of a sink strainer for stopping the passage of solids into a sink drain while allowing maximum flow efficiency of liquids.

Another object of the invention is the provision of a sink strainer which prevents passage of solids and captures solids for convenient disposal.

A further object of the invention is the provision of a sink strainer which is inexpensive to manufacture and extremely convenient in use.

Other objects and many of the attendant advantages of the present invention will be readily appreciated as the same becomes better understood by reference to the following detailed description when considered in connection with the accompanying drawings in which like reference numerals designate like parts throughout the Figures thereon and wherein.

DETAILED DESCRIPTION OF THE DRAWING

Figure 1:
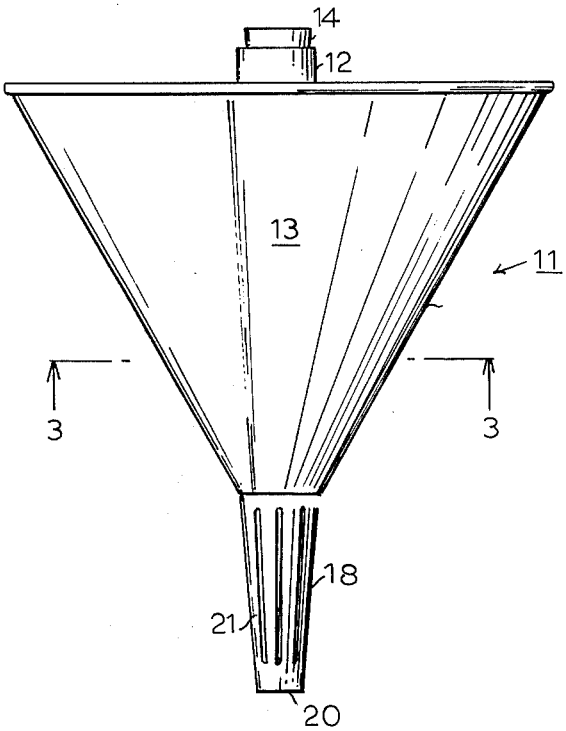
FIG. 1 is a side elevational view of the preferred embodiment of the present invention.

Referring to FIG. 1, the preferrred embodiment of the present invention is shown generally at 11 having a vertical strainer portion 12 coupled to and surrounded by a funnel portion 13. A stopper 14 is received by a top opening of vertical strainer portion 12. A bottom narrowed portion 18 of funnel portion 13 is received by drain 21 indicated in phantom in bottom sink surface 15 also indicated in phantom. Bottom portion 18 terminates with an opening at 20.

Figure 2:
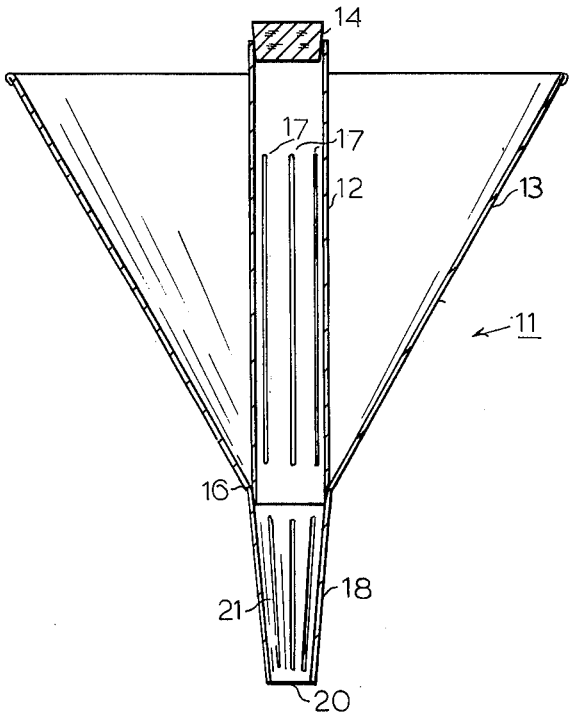
FIG. 2 is a cross-sectional view of the embodiment of FIG. 1.
Figure 3:
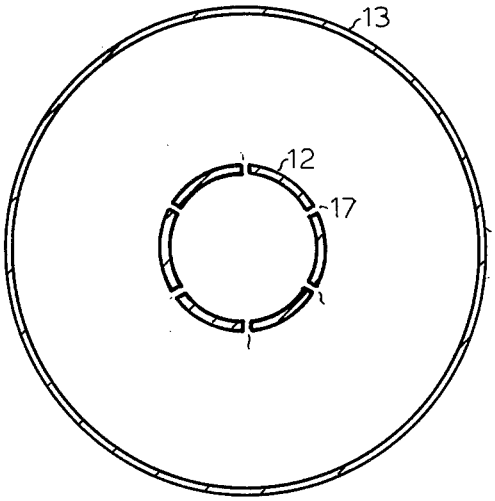
FIG. 3 is a cross-sectional view of the embodiment of FIG. 1 taken along lines 3—3.

Referring to FIGS. 2 and 3, vertical strainer member 12 has a plurality of vertical slots 17 therein. Strainer member 12 is coupled at 16 to funnel member 13 as by soldering, welding, etc.

Figure 4:
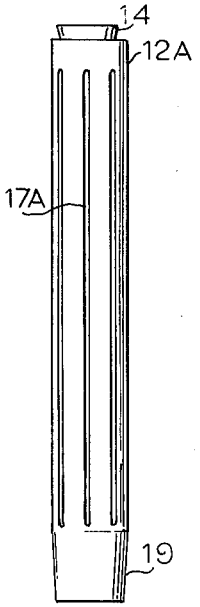
FIG. 4 is a side elevational view of a modification of the embodiment of FIG. 1.

Referring to FIG. 4, vertical strainer member 12A is shown with stopper 14 in a top orifice thereof and with vertical slots 17A terminating in a tapered reduced diameter section 19 dimensioned for insertion in a sink drain.

OPERATION

Referring back to FIGS. 1, 2, and 3, it can be seen that lower portion 18 of funnel member 12 is dimensioned for being received by a drain 21 in a bottom of a sink 15. As refuse is thrown into the top of funnel 13, such as the remains of beverages with sections of fruit therein for example, the solids are held within funnel member 13 while the fluids pass through slots 17 of the strainer member 12 and down through lower section 18 of funnel member 13 and its bottom orifice 20. When funnel member 13 begins to fill with solids, the entire assembly can be conveniently removed and emptied into a refuse container. Stopper 14 prevents any solids from falling into the top of strainer member 12 while at the same time facilitates cleaning of strainer member 12. Flutes 21 allow free flow around bottom portion 18 of funnel member 13.

Referring to FIG. 4, a second embodiment is shown which has eliminated the funnel member 13 and added a tapered lower section 19 for insertion into a sink drain.

It should be understood, of course, that the foregoing disclosure relates to only a preferred embodiment of the invention, and that it is intended to cover all changes and modifications of the example of the invention herein chosen, for the purposes of the disclosure, which do not constitute departures from the spirit and scope of the invention.

The invention claimed is:

1. A sink strainer comprising:

a hollow vertical cylindrical member open on each end thereof, said vertical cylindrical member having a lower end portion dimensioned for being snugly received by a sink drain opening;

a plurality of vertical slots disposed in said vertical cylindrical members; and a funnel member coupled to a lower portion of said vertical cylindrical member above said lower end portion, said funnel member diverging toward the plane of the top portion of said vertical cylindrical member.

2. The sink strainer of claim 1 and further including:

a stopper removably inserted in said top opening of said vertical cylindrical member, while leaving said slots open and functional, the removability of said stopper facilitating cleaning.

* * * * *